US007635950B2

(12) United States Patent
Tanba et al.

(10) Patent No.: US 7,635,950 B2
(45) Date of Patent: Dec. 22, 2009

(54) SHORT-ARC TYPE HIGH PRESSURE DISCHARGE LAMP HAVING GAPS FORMED AMONG ELECTRODE AXES, METAL FOILS AND A GLASS MATERIAL SURFACE

(75) Inventors: Kiyotaka Tanba, Aichi (JP); Takayuki Kagami, Aichi (JP); Masaru Mitsui, Nagano (JP); Nobuo Kanai, Nagano (JP); Yasuhito Sakai, Nagano (JP)

(73) Assignees: Sony Corporation, Tokyo (JP); Orc Manufacturing Co., Ltd., Tokyo (JP)

( * ) Notice: Subject to any disclaimer, the term of this patent is extended or adjusted under 35 U.S.C. 154(b) by 624 days.

(21) Appl. No.: 11/391,175

(22) Filed: Mar. 29, 2006

(65) Prior Publication Data

US 2007/0013288 A1 Jan. 18, 2007

(30) Foreign Application Priority Data

Mar. 31, 2005 (JP) ..... 2005-103540

(51) Int. Cl.
*H01J 17/04* (2006.01)
*H01J 17/26* (2006.01)

(52) U.S. Cl. ..... 313/631; 313/231.71

(58) Field of Classification Search ..... None
See application file for complete search history.

(56) References Cited

U.S. PATENT DOCUMENTS 6,686,677 B2 * 2/2004 Kondo et al. ..... 313/113
2002/0105272 A1 8/2002 Takagaki et al.
2003/0076040 A1 4/2003 Kumada et al.
2003/0168981 A1 9/2003 Kanzaki
2006/0232211 A1 10/2006 Welters et al.

FOREIGN PATENT DOCUMENTS

| | | |
|---|---|---|
| EP | 1 308 987 A2 | 5/2003 |
| EP | 1 343 196 A2 | 9/2003 |
| JP | 2003-051210 | 2/2003 |
| JP | 3518533 | 2/2004 |
| WO | WO 2004/097892 A2 | 11/2004 |

* cited by examiner

*Primary Examiner*—Toan Ton
*Assistant Examiner*—Britt D Hanley
(74) *Attorney, Agent, or Firm*—Finnegan, Henderson, Farabow, Garrett & Dunner, L.L.P.

(57) ABSTRACT

A short-arc type high pressure discharge lamp in which durability is improved and a lamp apparatus including the same is provided.

Glass material portions 52A into which glass material enters respectively are provided on both sides of an electrode axis 5402 between the outer circumferential surface 5406 thereof and a curved portion 58 of a sealed metal foil 56, and a gap S3 being continuous with a sealed space 60 remains among the glass material portion 52A, the outer circumferential portion 5406 of the electrode axis 5402, and the curved portion 58. An angle formed by a surface 52-1 of the glass material portion 52A facing the gap S3 and the curved portion 58 is an obtuse angle ϕ. In other words, an angle formed by the surface 52-1 of the glass material portion 52A facing the gap S3 and a surface 5602 of the curved portion 58 of the sealed metal foil 56 is the obtuse angle ϕ.

6 Claims, 12 Drawing Sheets

SHORT-ARC TYPE HIGH PRESSURE DISCHARGE LAMP HAVING GAPS FORMED AMONG ELECTRODE AXES, METAL FOILS AND A GLASS MATERIAL SURFACE

CROSS REFERENCES TO RELATED APPLICATIONS

The present invention contains subject matter related to Japanese Patent Application JP 2005-103540 filed in the Japanese Patent Office on Mar. 31, 2005, the entire contents of which being incorporated herein by reference.

BACKGROUND OF THE INVENTION

1. Field of the Invention

The present invention relates to a short-arc type high pressure discharge lamp and a lamp apparatus including the same.

2. Description of the Related Art

A short-arc type high pressure discharge lamp has been used as a light source of a projection type projector. FIG. 1 is a sectional view showing a short-arc type high pressure discharge lamp in related art; FIG. 2 is a sectional view showing a manufacturing process of a short-arc type high pressure discharge lamp in related art; FIGS. 3A through 3C are A-A line cross-sectional views of FIG. 2; FIG. 4 is an enlarged view showing portions of an electrode axis and a sealed metal foil; and FIG. 5A is an enlarged view showing the portions of the electrode axis and sealed metal foil and FIG. 5B is an enlarged view showing the inside of a circle in FIG. 5A.

As shown in FIG. 1, a short-arc type high pressure discharge lamp 10 includes: a discharge container 12 made of glass material such as quartz glass, a pair of electrodes 14, and two sealed metal foils 16. The discharge container 12 is formed of a pair of axis portions 1202 and a swelled portion 1204 provided between the pair of axis portions 1202 and having a sealed space 20 inside in which mercury and the like are enclosed.

Each of electrodes 14 has an electrode axis 1402 and an electrode body 1404 provided at an end of the electrode axis 1402. With respect to the pair of electrodes 14, the electrode axes 1402 are buried in the pair of axis portions 1202 respectively and the electrode bodies 1404 are disposed to face each other in the sealed space 20. Two sealed metal foils 16 extend like a strip having a narrow width and are buried in the axis portions 1202 such that the longitudinal direction thereof is parallel to the longitudinal direction of the axis portion 1202. The electrode axis 1402 is joined to one end in the longitudinal direction of the sealed metal foil 16 by resistance welding, and a lead wire 18 is joined to the other end in the longitudinal direction by the resistance welding. When lighting the short-arc type high pressure discharge lamp 10, on connecting an outside power source to each lead wire 18 and on applying a voltage to each electrode 14, an electric discharge occurs between the electrode bodies 1404 to make the sealed space 20 become a high temperature exceeding 300° C., mercury in the sealed space 20 is vaporized to be a mercury vapor pressure of around 200 atmospheric pressure for example, and light is emitted by an arc discharge occurred between the electrode bodies 1404 in that state.

The above short-arc type high pressure discharge lamp 10 is manufactured as follows. First, as shown in FIG. 2, a glass tube 22 whose diameter is larger than that of the axis portion 1202 of the discharge container 12 is prepared. The glass tube 22 has a pair of small diameter portions 2202 having an inner diameter larger than the width of the sealed metal foil 16, and a large diameter portion 2204 provided between those small diameter portions 2202 and having a larger inner diameter than the inner diameter of the small diameter portion 2202. First, with mercury as a base Ar gas and halogen gas are injected into the large diameter portion 2204. Next, each of the pair of electrodes 14 to which the sealed metal foil 16 is welded is inserted respectively from each of small diameter portion 2202 of the glass tube 22 toward the large diameter portion 2204 to make the electrode bodies 1404 face each other in the large diameter portion 2204. At that time, the electrode axis portion 1402 welded to the sealed metal foil 16 is positioned in the small diameter portion 2202 as shown in FIGS. 2 and 3A.

Next, the end portion of each small diameter portion 2202 positioned on the side opposite to the large diameter portion 2204 is irradiated with a laser light beam and is heated to fuse the end portions of the small diameter portions 2202 positioned around the lead wires 18 and so both ends of the glass tube 22 are sealed. Hence, the sealed space 20 hermetically sealed is formed inside the large diameter portion 2204. Next, while cooling down the mercury in the sealed space 20 to prevent evaporation thereof by exposing the large diameter portion 2204 to liquid nitrogen, laser light beams are applied moving from the end portion of each small diameter portion 2202 toward the large diameter portion 2204 and so the whole area of the small diameter portion 2202 is sequentially heated. Hence, the portion of the small diameter portion 2202 around the lead wire 18 and the portion of the small diameter portion 2202 around the sealed metal foil 16 are fused. At this time, a barometric pressure inside the discharge container 12 is equal to or lower than the atmospheric pressure, because the large diameter portion 2204 is cooled down with the liquid nitrogen. Accordingly, as shown in FIG. 3B, the fused small diameter portion 2202 is shrunk to have a small outer diameter due to the difference in the pressure.

Further, when the inner surface of the fused small diameter portion 2202 contacts with both ends in the widthwise direction of the sealed metal foil 16, the inner surface of the fused small diameter portion 2202 shrinks to come close toward the sealed metal foil 16 in the direction orthogonal to the widthwise direction of the sealed metal foil 16 as shown in FIG. 3C, because the sealed metal foil 16 serves as resistance. Then, the portion of the fused small diameter portion 2202 wraps the electrode axis 1402 and sealed metal foil 16 to be in a state where, as shown in FIG. 4, the portion of the fused small diameter portion 2202, that is, the fused glass material portion closely contacts with the whole area of the rear surface 1604 on the side opposite to a surface 1602 of the sealed metal foil 16 to which the electrode axis 1402 is welded. Further, a fused glass material portion 12A closely contacts with a portion of the outer circumferential surface 1402A on the side opposite to the sealed metal foil 16 in the outer circumferential surface 1402A of the electrode axis 1402. The short-arc type high pressure discharge lamp 10 as shown in FIG. 1 is obtained in this manner.

Hereupon, as shown in FIGS. 5A and 5B, since the glass material portion 12A may not fully enter on both sides of the electrode axis 1402 between the outer circumferential surface 1402A thereof and the surface 1602 of the sealed metal foil 16 to which the electrode axis 1402 is welded, gaps S are formed respectively. The gap S is continuous with the sealed space 20. Further, it is illustrated in FIG. 5A that the fused glass material may closely contact with half the outer circumferential surface 1402A of the electrode axis 1402 on the side opposite to the portion to which the sealed metal foil 16 is welded, however, the gaps S on both sides of the electrode axis 1402 are in actuality continuous with each other through the half portion of the outer circumferential surface 1402A of the electrode axis 1402. The gaps S on both sides of the electrode axis 1402 are formed to be gradually small in the direction away from the electrode axis 1402 and along the surface 1602 of the sealed metal foil 16, and a surface 12-1 of the glass material portion 12A facing the gap S forms an acute angle θ with the surface 1602 of the sealed metal foil 16. Therefore, when the short-arc type high pressure discharge lamp 10 is lit, mercury vapor pressure rises in the sealed space 20 and so pressure in the gap S also rises, and strong force almost like a wedge acts on a portion of a gap S1 that is the acute angle θ formed by the surface 12-1 of the glass material portion 12A facing the gap S and the surface 1602 of the sealed metal foil 16.

Then, a crack may occur from that portion of the gap S1 along the boundary surface between the surface 1602 of the sealed metal foil 16 and the surface 12-1 of the glass material portion 12A, which is a disadvantage on improving the durability of the short-arc type high pressure discharge lamp 10. In order to solve such problem, it has been proposed to change the shape of the sealed metal foil 16 (refer to Patent Reference 1). FIG. 6A is a plan view showing portions of the electrode axis 1402 and the sealed metal foil 16 in an example of related art in which the shape of the sealed metal foil is changed; and FIG. 6B is a BB-line cross-sectional view of FIG. 6A. As shown in FIGS. 6A and 6B, the sealed metal foil 16 is wrapped up to a portion opposite to a portion welded to the sealed metal foil 16 along the outer circumferential surface 1402A of the electrode axis 1402 in the portion where the electrode axis 1402 is welded to the sealed metal foil 16 and so the gaps S formed on both sides of the electrode axis 1402 between the outer circumferential surface 1402A thereof and the surface 1602 of the sealed metal foil 16 are eliminated.

[Patent Reference 1] Japanese Patent No. 3518533

SUMMARY OF THE INVENTION

In the above-described example of the related art in which the shape of the sealed metal foil is changed, as shown in FIG. 6B, the sealed metal foil 16, is bent at the portion opposite to the portion welded to the sealed metal foil 16 and so this time V-shaped concave portions are formed respectively on both sides of the electrode axis 1402 at the bent portion on the rear surface 1604 of the sealed metal foil 16. Further, since the glass material portion 12A may not completely enter the respective concave portions and gaps S2 continuous with the sealed space 20 are formed, and since an acute angle θ is formed by a surface 12-2 of the glass material portion 12A facing the gap S2 and the rear surface 1604 of the sealed metal foil 16 similarly to the above, there is a possibility that when the short-arc type high pressure discharge lamp 10 is lit, a crack may occur due to strong force that acts almost like a wedge along the boundary surface between the rear surface 1604 of the sealed metal foil 16 and the surface 12-2 of the glass material portion 12A similarly to the above. The present invention addresses the above-identified and other problems associated with conventional methods and apparatuses, and provides a short-arc type high pressure discharge lamp enabling durability to be improved and a lamp apparatus including the short-arc type high pressure discharge lamp.

A short-arc type high pressure discharge lamp according to an embodiment of the present invention includes a discharge container made of glass material, a pair of electrodes, and two sealed metal foils electrically connected to the pair of electrodes respectively. The discharge container is formed of a pair of axis portions and a swelled portion provided between the pair of axis portions and having a sealed space inside. Each of electrodes includes an electrode axis and an electrode body provided at an end of the electrode axis, the electrode axes are buried in the pair of axis portions, and the electrode bodies are disposed to face each other in the sealed space. The sealed metal foil is in the shape of a strip having a narrow width and is formed to be buried together with the electrode axis in the axis portion, in a state where a middle portion in the widthwise direction at one end in the longitudinal direction of the sealed metal foil is made into a curved portion wrapping the outer circumferential surface of the electrode axis and the most depressed bottom portion of the curved portion is joined to a portion of the outer circumferential surface of the electrode axis contacting with the bottom portion, and the other end in the longitudinal direction of the sealed metal foil is connected to an outside power source. Glass material portions into which the glass material enters respectively are provided on both sides of the electrode axis between the outer circumferential surface thereof and the curved portion of the sealed metal foil. On both sides of the electrode axis between the outer circumferential surface thereof and the curved portion of the sealed metal foil, gaps continuous with the sealed space remain respectively among the glass material portion, the outer circumferential surface of the electrode axis, and the curved portion. The gap is formed to be gradually small in the direction away from the glass material portion and along a circumferential direction of the electrode axis. The surface of the glass material portion facing the gap forms an obtuse angle with the curved portion.

A lamp apparatus according to an embodiment of the present invention includes: a short-arc type high pressure discharge lamp, a protective tube that accommodates the short-arc type high pressure discharge lamp in a hermetically sealed state, an opening provided in the front portion of the protective tube, a transparent panel that hermetically closes the opening, a reflective surface provided on the inner surface of the protective tube to reflect light emitted from the short-arc type high pressure discharge lamp and to lead forward the light through the transparent panel, and a power-feed terminal provided on the outer surface of the protective tube and connected to an outside power source. The short-arc type high pressure discharge lamp includes: a discharge container made of glass material, a pair of electrodes, and two sealed metal foils electrically connected to the pair of electrodes, respectively. The discharge container is formed of a pair of axis portions and a swelled portion provided between the pair of axis portions and having a sealed space inside. Each of electrodes includes an electrode axis and an electrode body provided at an end of the electrode axis, the electrode axes are buried in the pair of axis portions, and the electrode bodies are disposed to face each other in the sealed space. The sealed metal foil is in the shape of a strip having a narrow width and is formed to be buried together with the electrode axis in the axis portion, in a state where a middle portion in the widthwise direction at one end in the longitudinal direction of the sealed metal foil is made into a curved portion wrapping the outer circumferential surface of the electrode axis and the most depressed bottom portion of the curved portion is joined to a portion of the outer circumferential surface of the electrode axis contacting with the bottom portion. The other end in the longitudinal direction of the sealed metal foil is connected to the power-feed terminal. Glass material portions into which the glass material enters respectively are provided on both sides of the electrode axis between the outer circumferential surface thereof and the curved portion of the sealed metal foil. On both sides of the electrode axis between the outer circumferential surface thereof and the curved portion of the sealed metal foil, gaps continuous with the sealed space remain respectively among the glass material portion, the outer circumferential surface of the electrode axis, and the curved portion. The gap is formed to be gradually small in the direction away from the glass material portion and along a circumferential direction of the electrode axis. The surface of the glass material portion facing the gap forms an obtuse angle with the curved portion.

According to the embodiments of the present invention, since the surface of the glass material portion facing the gap continuous with the sealed space forms an obtuse angle with the curved portion of the sealed metal foil, the force that acts on the portion of the gap forming the obtuse angle can almost be ignored in the case in which mercury vapor pressure in the sealed space rises to cause the rise of pressure in the gap. Accordingly, a crack can be prevented from occurring at the portion of the gap along the boundary surface between the surface of the sealed metal foil and the surface of the glass material portion, which enables durability of the short-arc type high pressure discharge lamp and lamp apparatus to be improved.

DESCRIPTION OF THE PREFERRED EMBODIMENTS

Figure 1:
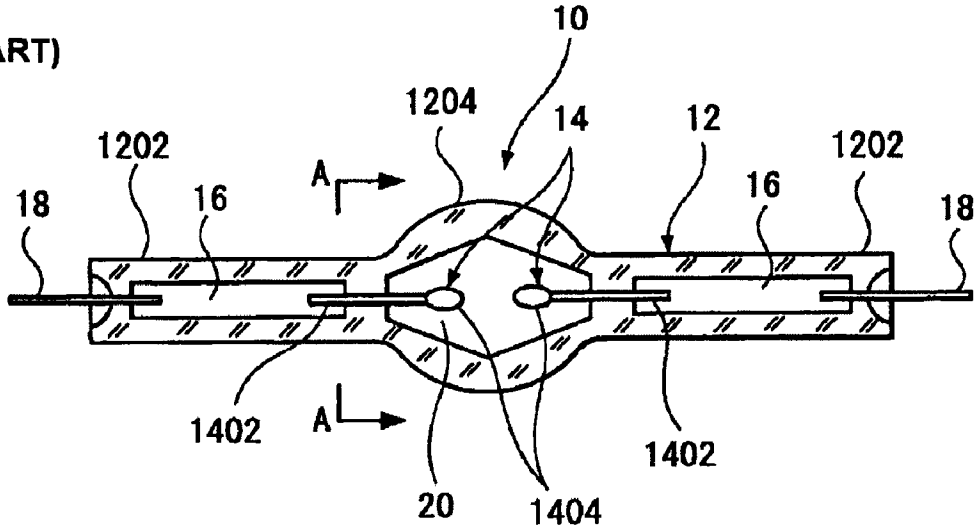
FIG. 1 (PRIOR ART)
FIG. 1 is a sectional view of a short-arc type high pressure discharge lamp of related art.
Figure 2:
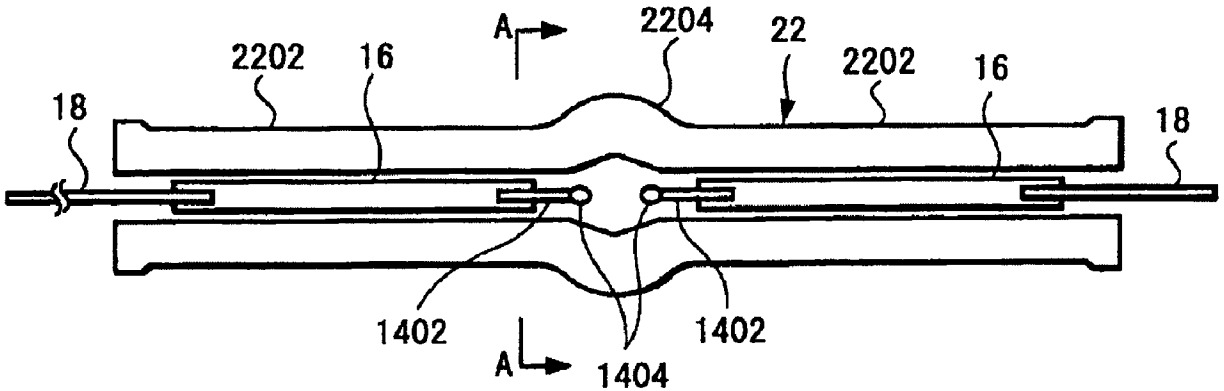
FIG. 2 (PRIOR ART)
FIG. 2 is a sectional view showing a manufacturing process of a short-arc type high pressure discharge lamp of related art.
Figure 3A:
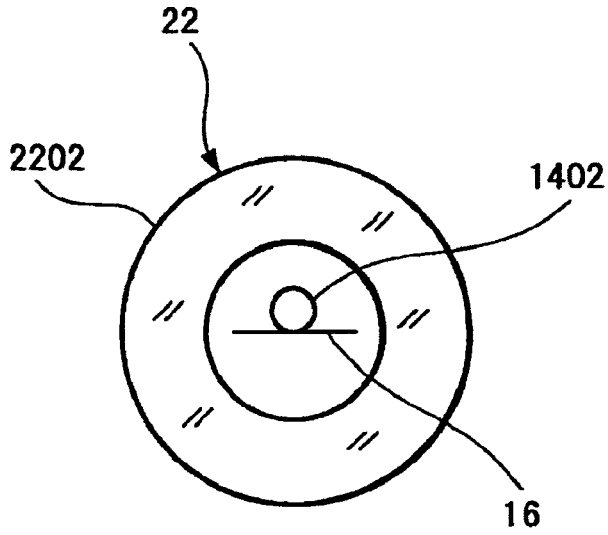
FIG. 3A (PRIOR ART)
FIGS. 3A through 3C are AA-line cross-sectional views of FIG. 2.
Figure 3B:
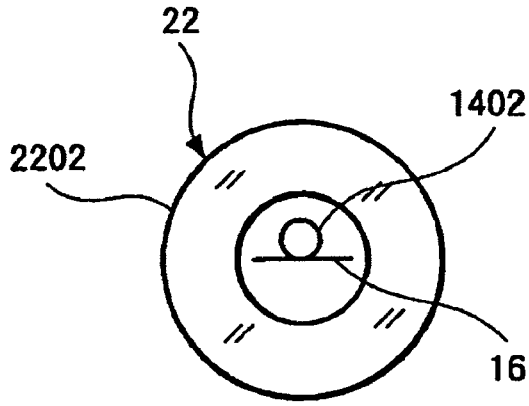
FIG. 3B (PRIOR ART)
Figure 3C:
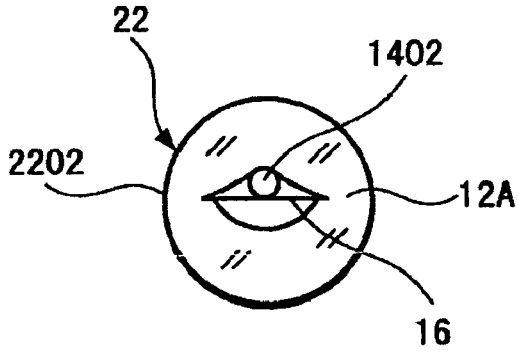
FIG. 3C (PRIOR ART)
Figure 4:
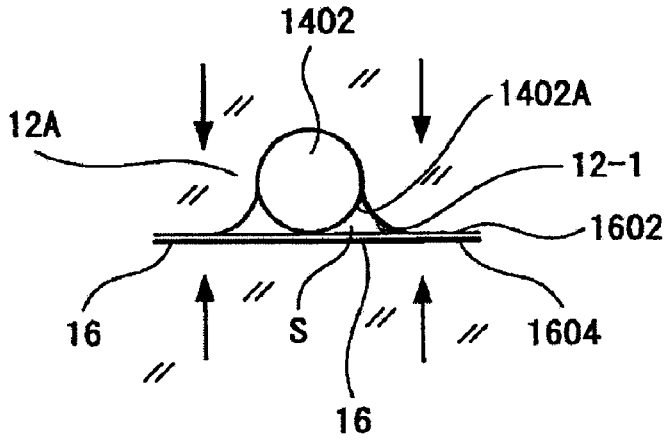
FIG. 4 (PRIOR ART)
FIG. 4 is an enlarged view showing portions of an electrode axis and a sealed metal foil.
Figure 5A:
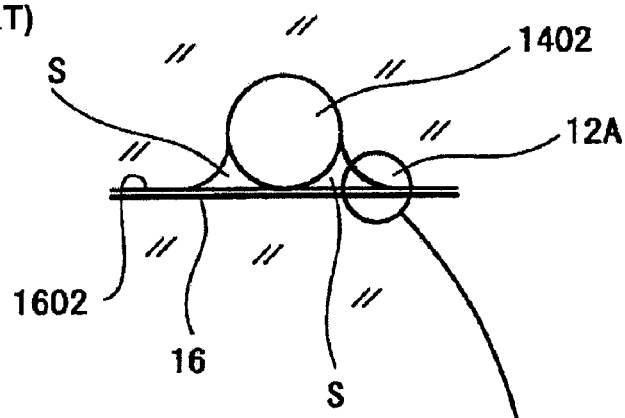
FIG. 5A (PRIOR ART)
FIG. 5A is an enlarged view showing the portions of the electrode axis and sealed metal foil.
Figure 5B:
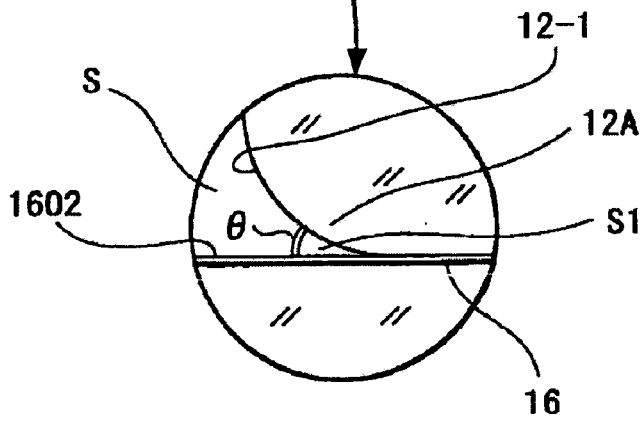
FIG. 5B (PRIOR ART)
FIG. 5B is an enlarged view showing the inside of a circle in FIG. 5A.
Figure 6A:
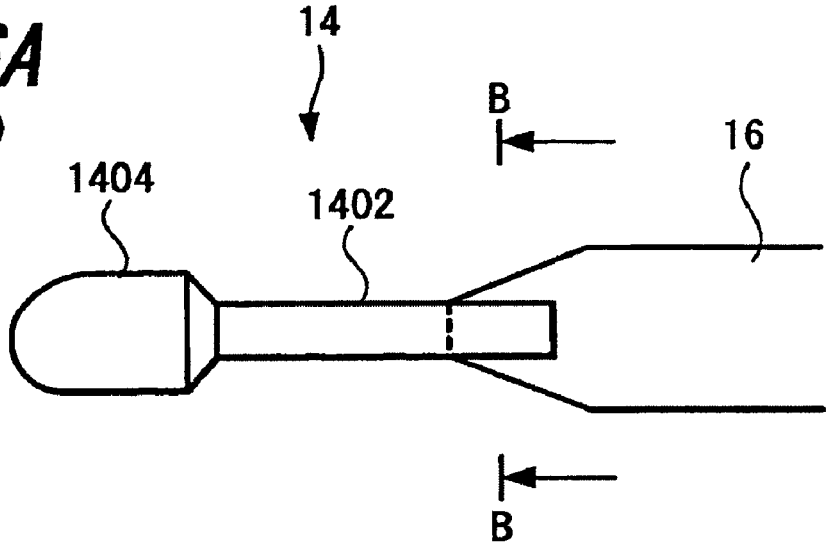
FIG. 6A (PRIOR ART)
FIG. 6A is a plan view showing portions of an electrode axis and a sealed metal foil of related art in which the shape of the sealed metal foil is changed.
Figure 6B:
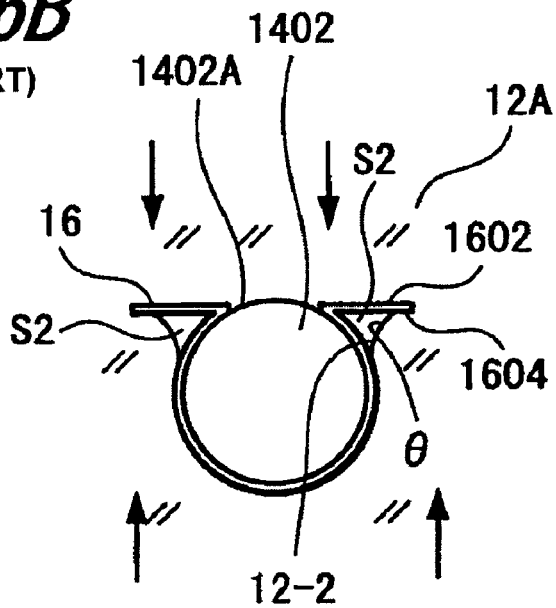
FIG. 6B (PRIOR ART)
FIG. 6B is a BB-line cross-sectional view of FIG. 6A.
Figure 7:
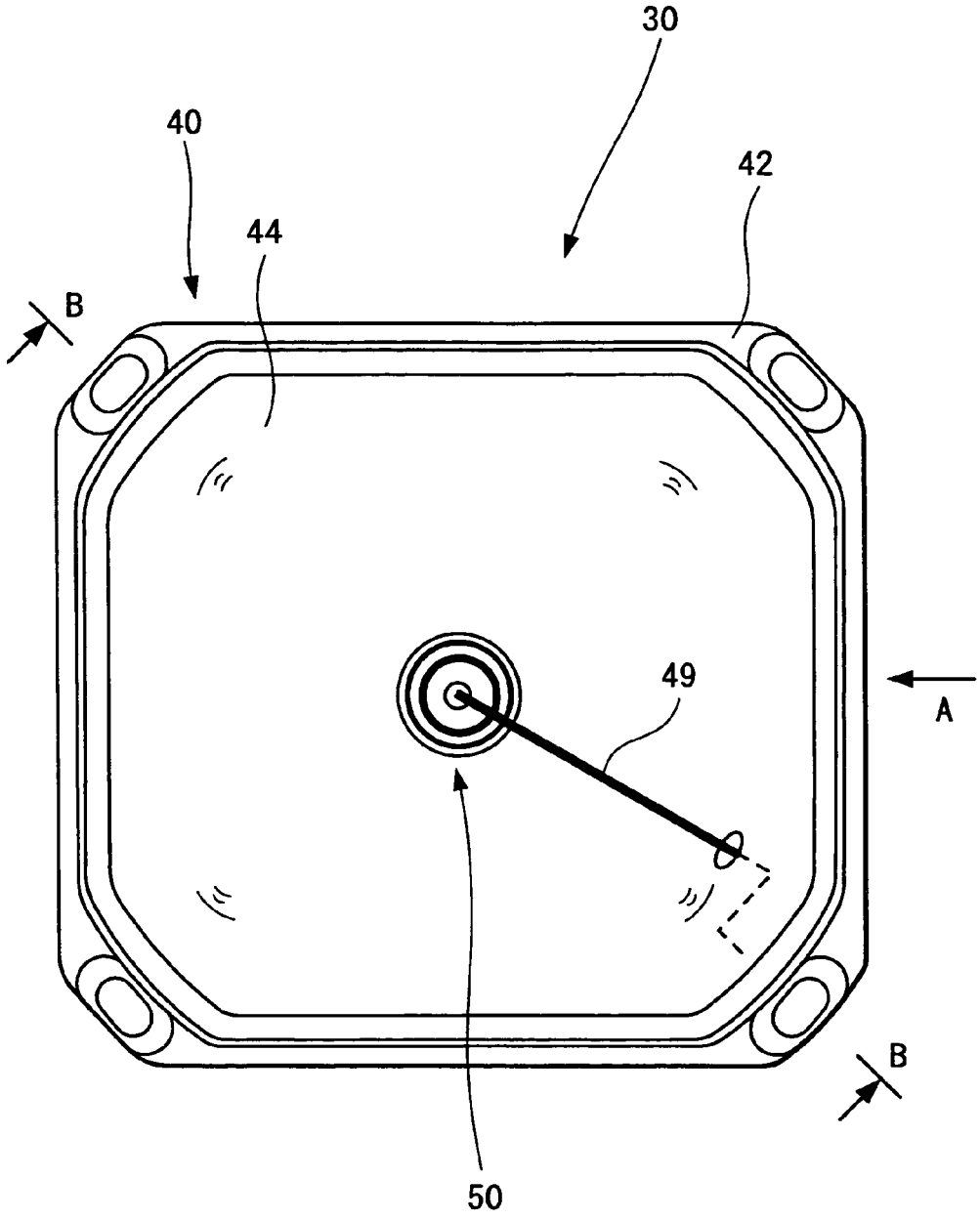
FIG. 7 is a front view of a lamp apparatus according to an embodiment of the present invention.
Figure 8:
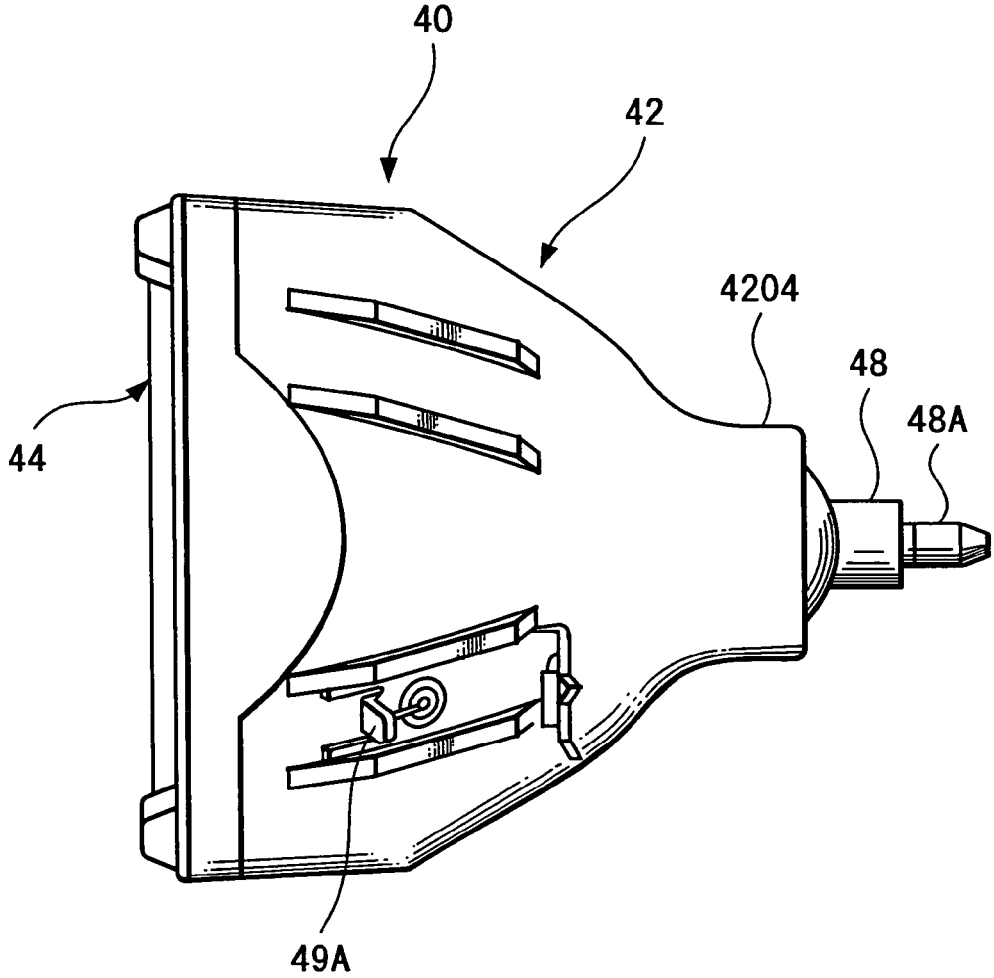
FIG. 8 is a view seen from the side indicated by the A-arrow of FIG. 7.
Figure 9:
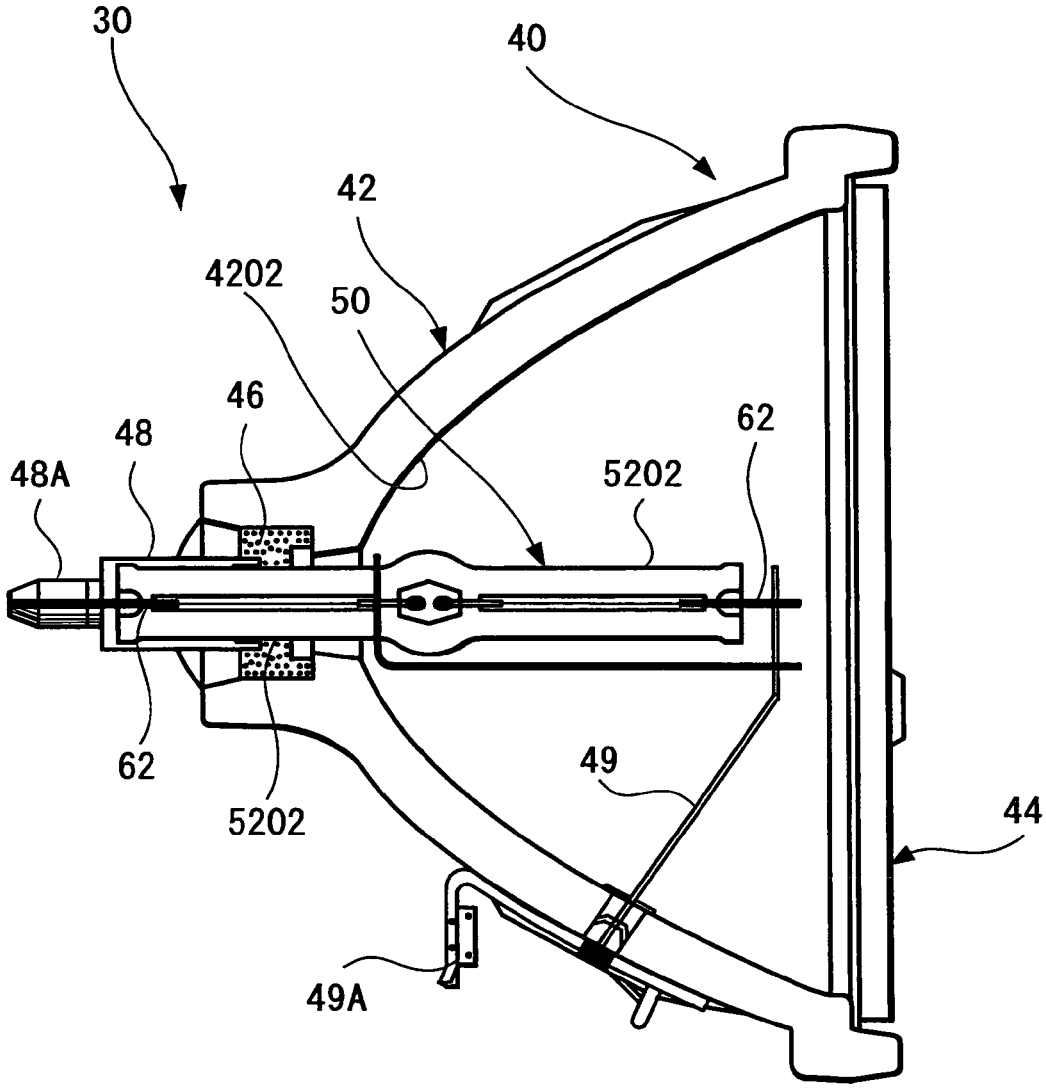
FIG. 9 is a BB-line sectional view of FIG. 7.

Next, an embodiment of the present invention is explained by referring to the accompanied drawings. In the following, an explanation is made with respect to the case in which a short-arc type high pressure discharge lamp according to an embodiment of the present invention is incorporated in a lamp apparatus. FIG. 7 is a front view of a lamp apparatus according to a first embodiment; FIG. 8 is a view seen from the side indicated by the A-arrow of FIG. 7; and FIG. 9 is a BB-line sectional view of FIG. 7. A lamp apparatus 30 includes a short-arc type high pressure discharge lamp 50 according to an embodiment of the present invention and a protective tube 40 that accommodates the short-arc type high pressure discharge lamp 50 in a hermetically sealed state. The protective tube 40 includes a funnel-shaped body portion 42 made of hard glass having a parabolic reflective surface 4202 as an inner surface and a transparent panel 44 made of hard glass that hermetically seals a front opening of the body portion 42. One of axis portions 5202 of the short-arc type high pressure discharge lamp 50 is inserted into a neck portion 4204 of the body portion 42 from the inside of the body portion 42, and heat-resistant sealant 46 is filled in a gap formed between the outer circumferential surface of the axis portion 5202 and an inner circumferential surface of the neck portion 4204. Therefore, the short-arc type high pressure discharge lamp 50 is fixed airtightly to the neck portion 4204 of the body portion 42. Further, one of the axis portion 5202 of the short-arc type high pressure discharge lamp 50 that protrudes outward from the neck portion 4202 is airtightly capped with a cap 48. Furthermore, a power-feed terminal 48A is provided for the cap 48, and one of a pair of lead wires 62 of the short-arc type high pressure discharge lamp 50 is connected to the power-feed terminal 48A. Further, a power-feed terminal 49A is also provided on the outside surface of the body portion 42, and the other of the pair of lead wires 62 is connected to the power-feed terminal 49A through a lead conductor 49. Note that the inside of the protective tube 40 is sealed with nitrogen gas so that heat of the short-arc type high pressure discharge lamp 50 is radiated excellently to the outside of the protective tube 40.

Figure 10:
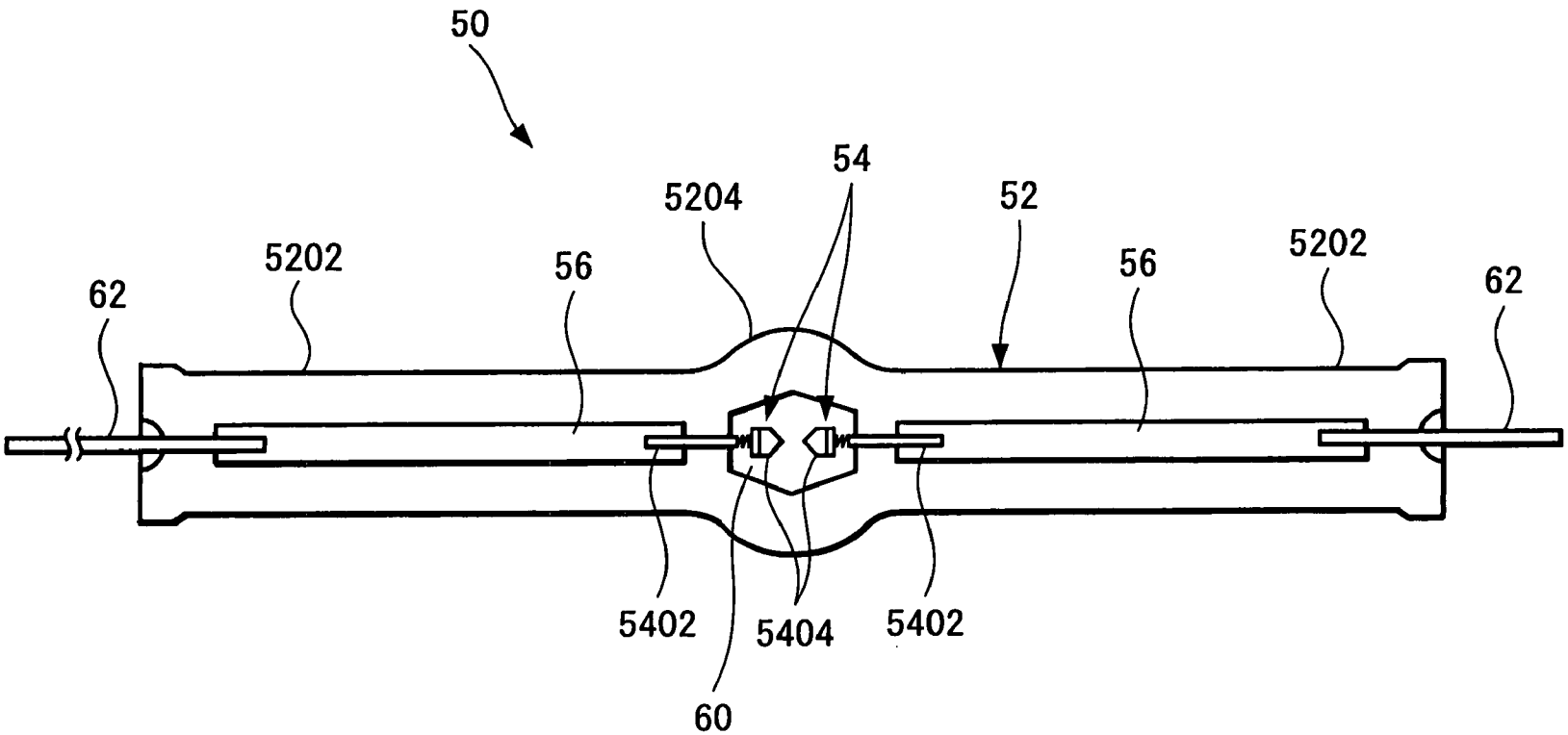
FIG. 10 is a sectional view of a short-arc type high pressure discharge lamp according to an embodiment of the present invention.
Figure 11:
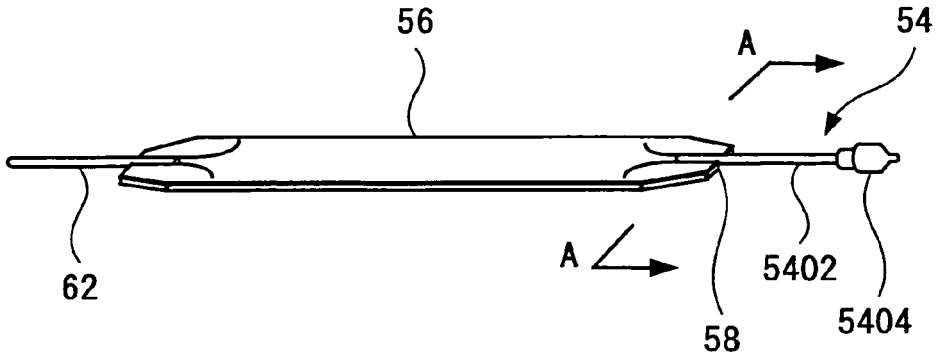
FIG. 11 is a perspective view of a sealed metal foil to which an electrode axis and a lead wire are welded.
Figure 12:
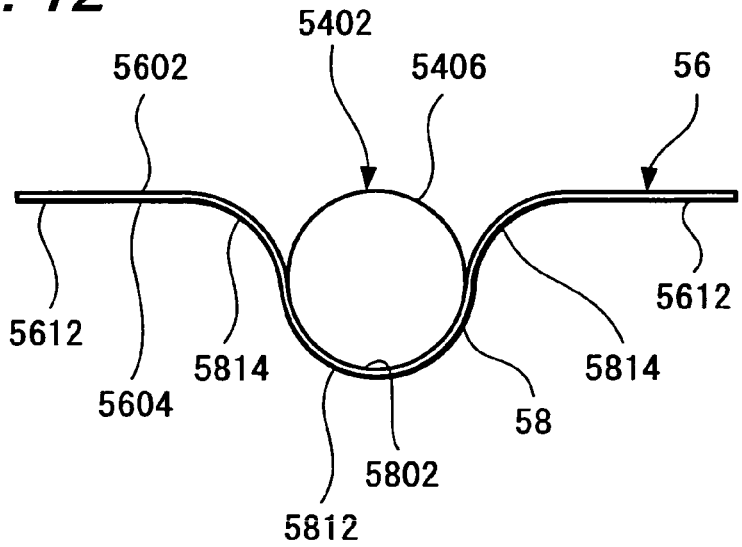
FIG. 12 is an AA-line cross-sectional view of FIG. 11.

FIG. 10 is a sectional view of a short-arc type high pressure discharge lamp according to an embodiment of the present invention; FIG. 11 is a perspective view of a sealed metal foil to which an electrode axis and a lead wire are welded; and FIG. 12 is an AA-line cross-sectional view of FIG. 11. As shown in FIG. 10, the short-arc type high pressure discharge lamp 50 includes a discharge container 52 made of glass material, a pair of electrodes 54, and two sealed metal foils 56. In this embodiment, the glass material constituting the discharge container 52 is quartz glass. The discharge container 52 is formed to have a pair of axis portions 5202 and a swelled portion 5204 provided between the pair of axis portions 5202 and having a sealed space 60 inside in which mercury and the like are filled. Each of the electrodes 54 has an electrode axis 5402 and an electrode body 5404 provided at an end of the electrode axis 5402, in which in this embodiment the pair of electrodes 54 are formed of tungsten and the diameter of the electrode axis 5402 is 0.3 mm. With respect to the pair of electrodes 54, the electrode axes 5402 are buried in the pair of axis portions 5202 respectively, and the electrode bodies 5404 are disposed to face each other in the sealed space 60.

Figure 15A:
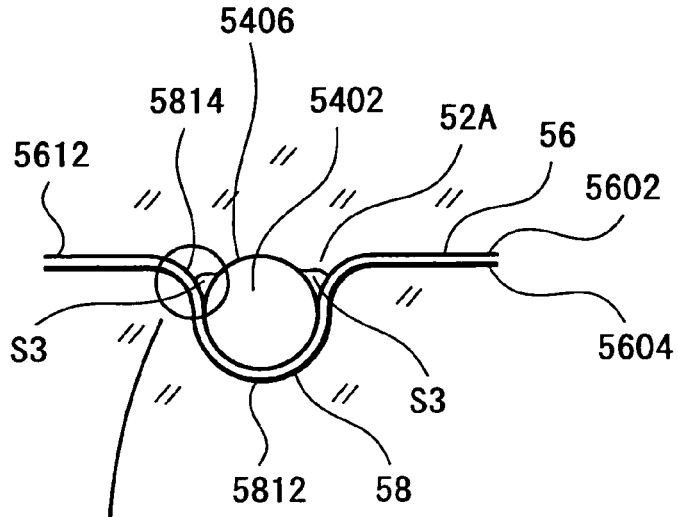
FIG. 15A is an enlarged view showing portions of an electrode axis and a sealed metal foil.
Figure 15B:
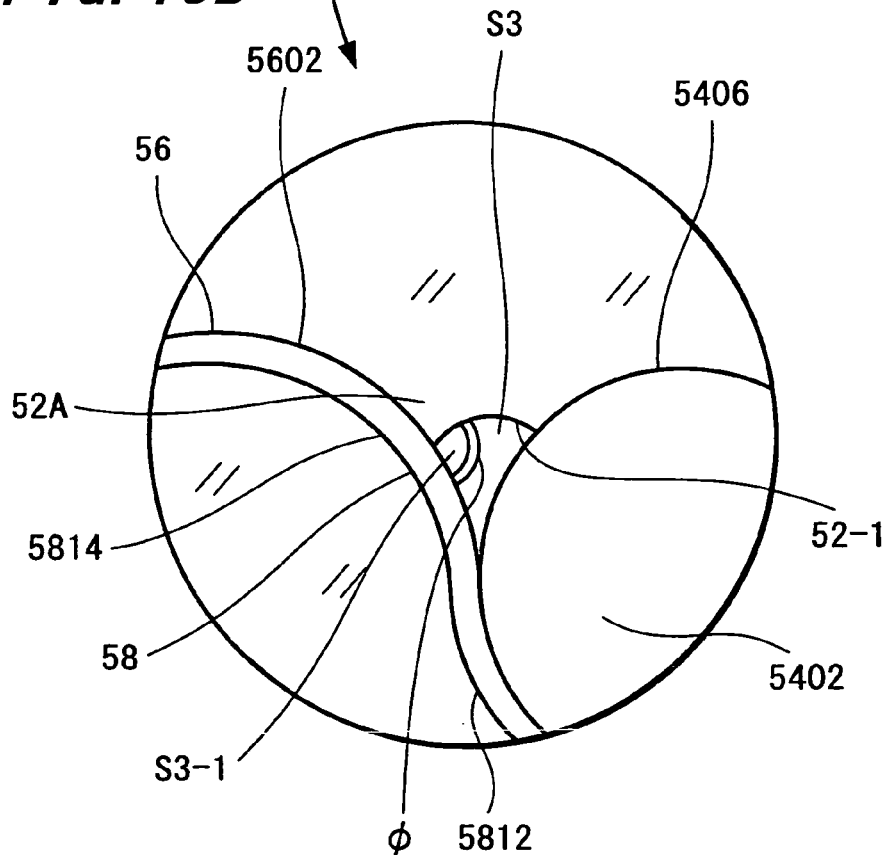
FIG. 15B is an enlarged view showing the inside of a circle in FIG. 15A.

The two sealed metal foils 56 extend like a strip having a narrow width. Each of sealed metal foils 56 is buried in the axis portion 52 in a state where the longitudinal direction thereof is made parallel with the longitudinal direction of the axis portion 52, a middle portion in the widthwise direction at one end in the longitudinal direction of the sealed metal foil 56 is made into a curved portion 58 wrapping the outer circumferential surface 5406 of the electrode axis 5402, and the most depressed bottom portion 5802 of the curved portion 58 is joined to a portion of the outer circumferential surface 5406 of the electrode axis 5402 contacting with this bottom portion 5802. As shown in FIGS. 15A and 15B, glass material portions 52A into which glass material enters are provided respectively on both sides of the electrode axis 5402 between the outer circumferential surface 5406 thereof and the curved portion 58 of the sealed metal foil 56, and gaps S3 continuous with the sealed space 60 remain among the glass material portion 52A, the outer circumferential surface 5406 of the electrode axis 5402, and the curved portion 58.

The gap S3 is formed to be gradually small in the direction away from the glass material portion 52A and along a circumferential direction of the electrode axis 5402. The surface 52-1 of the glass material portion 52A facing the gap S3 forms an obtuse angle ϕ with the curved portion 58, in other words, an angle of a gap S3-1 formed at a portion where the surface 52-1 of the glass material portion 52A facing the gap S3 contacts with a surface 5602 of the curved portion 58 of the sealed metal foil 56 facing the gap S3 is an obtuse angle ϕ. The lead wire 62 is joined to the other end in the longitudinal direction of the sealed metal foil 56 by resistance welding and is formed to be connected to an outside power source through the power-feed terminals 48A and 49A described above. In this embodiment, two sealed metal foils 56 are made of molybdenum and the thickness thereof is 20 μm. The lead wire 62 is made of molybdenum and the diameter thereof is 0.4 mm. When an outside power source is connected to each lead wire 62 and a voltage is applied to each electrode 54 at the time of lighting the short-arc type high pressure discharge lamp 50, an electrical discharge occurs between the electrode bodies 5404, temperature of the sealed space 60 becomes high exceeding 300° C., mercury in the sealed space 60 evaporates to be mercury vapor pressure of around 200 barometric pressure, for example, and light is emitted by the arc discharge occurred between respective electrode bodies 5404 in that state.

Figure 13:
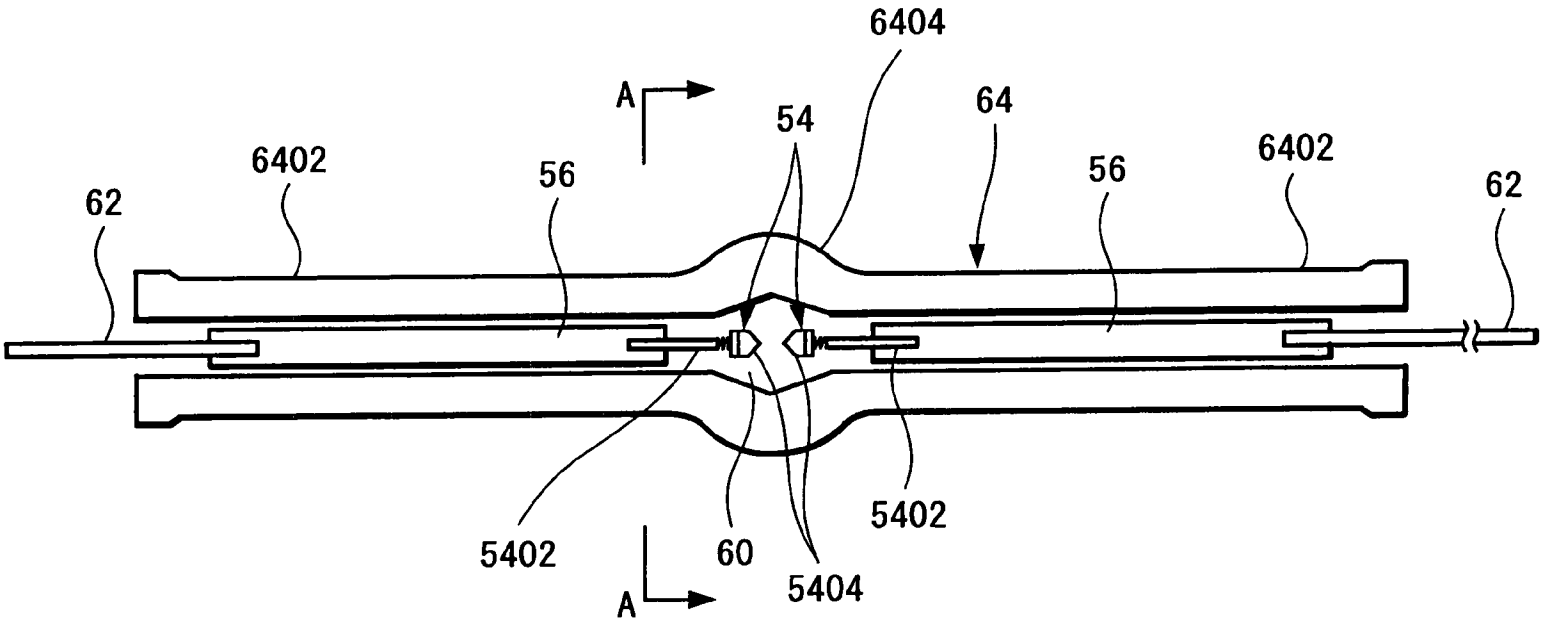
FIG. 13 is a sectional view showing a manufacturing process of a short-arc type high pressure discharge lamp according to an embodiment of the present invention.

Such short-arc type high pressure discharge lamp 50 is manufactured as follows. FIG. 13 is a sectional view showing a manufacturing process of a short-arc type high pressure discharge lamp according to a first embodiment, and FIGS. 14A through 14D are AA-line cross-sectional views of FIG. 13. First, as shown in FIG. 13, a glass tube 64 having a diameter larger than that of the axis portion 5202 of the discharge container 52 is prepared. The glass tube 64 includes a pair of small diameter portions 6402 having an inner diameter larger than the width of the sealed metal foil 56 and a large diameter portion 6404 having an inner diameter larger than the inner diameter of the small diameter portion 6402 and provided between the small diameter portions 6402. In addition, electrodes 54 are fixed to one end in the longitudinal direction of the pair of sealed metal foils 56, respectively.

Further in detail, as shown in FIG. 12, a middle portion (a center portion in this embodiment) in the widthwise direction at one end in the longitudinal direction of the sealed metal foil 56 is made into a semi-cylindrical portion 5812 wrapping half the outer circumferential surface 5406 of the electrode axis 5402 (in other words, the semi-cylindrical portion 5812 whose inner radius is equal to the outer circumferential surface 5406 of the electrode axis 5402), and the most depressed bottom portion 5802 of the semi-cylindrical portion 5812 is joined by resistance welding to the portion of the outer circumferential surface 5406 of the electrode axis 5402 contacting with the bottom portion 5802. Further, a cylindrical surface portion 5814 is formed extending from the upper end of the semi-cylindrical portion 5812, specifically, extending from the upper end of the semi-cylindrical portion 5812 positioned at the height approximately the radius of the electrode axis 5402 from the most depressed bottom portion 5802 of the semi-cylindrical portion 5812, gradually departing from the outer circumferential surface 5406 of the electrode axis 5402 at a cylindrical surface whose radius is equal to the radius of the electrode axis 5402, and continuously connecting (in a stepless manner) the upper end of the semi-cylindrical portion 5812 on both sides to flat portions 5612 remaining on both sides in the widthwise direction of the sealed metal foil 56. In this way, the semi-cylindrical portion 5812 and cylindrical surface portions 5814 on both sides constitutes the curved portion 58 wrapping the outer circumferential surface 5406 of the electrode axis 5402, provided in the middle portion in the widthwise direction at one end in the longitudinal direction of the sealed metal foil 56. Note that a virtual line connecting the flat portions 5612 on both sides passes at the upper end of the outer circumferential surface 5406 positioned opposite to the bottom portion 5802 and therefore the cylindrical surface portion 5814 is a convex-shaped cylindrical surface toward the upper end of the outer circumferential surface 5406 positioned opposite to the bottom portion 5802, and the depth of the curved portion 58 from the flat portions 5612 on both sides is almost equal to the diameter of the electrode axis 5402.

Figure 14A:
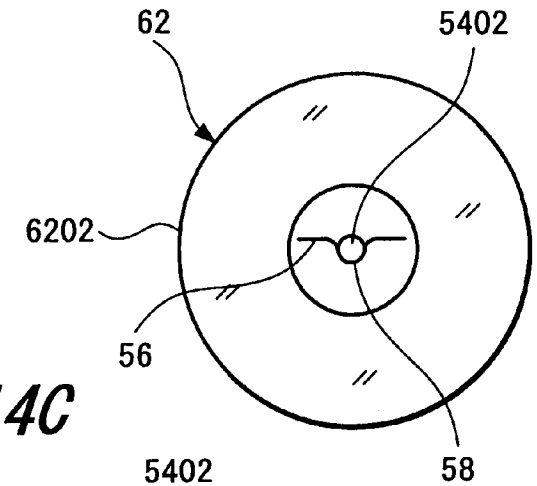
FIGS. 14A through 14D are AA-line cross-sectional views of FIG. 13.

Next, Ar gas and halogen gas with mercury as a base are injected into the large diameter portion 6404. Then, a pair of electrodes 54 in which the electrode axis 5402 is welded to the bottom portion 5802 of the curved portion 58 of the sealed metal foil 56 are inserted respectively toward the large diameter portion 6404 from the small diameter portions 6402 of the glass tube 64 to make the electrode bodies 5404 face each other in the large diameter portion 6404. At this time, as shown in FIGS. 13 and 14A, the portion of the electrode axis 5402 welded to the bottom portion 5802 of the curved portion 58 of the sealed metal foil 56 is positioned in the small diameter portion 6402.

The end portions of the small diameter portions 6402 positioned on the opposite side to the large diameter portion 6404 are irradiated with laser light beams and are heated, and so the edge portion of each small diameter portion 6402 positioned around the lead wire 62 is fused to seal both the ends of the glass tube 64. Hence, the hermetically sealed space 60 is formed inside the large diameter portion 6404. Subsequently, liquid nitrogen is applied to the large diameter portion 6404 to cool mercury in the sealed space 60 not to evaporate and the whole area of the small diameter portion 6402 is irradiated with the laser light beam to be heated sequentially by moving the light beam from the edge portion of each small diameter portion 6402 toward the large diameter portion 6404. Hence, the portion of the small diameter portion 6402 positioned around the lead wire 62 and the portion of the small diameter portion 6402 positioned around the sealed metal foil 56 are fused. At this time, the barometric pressure inside the discharge container 52 is equal to or less than the atmospheric pressure, because the large diameter portion 6404 has been cooled using the liquid nitrogen. Accordingly, the fused small diameter portion 6402 is shrunk to have a small outer diameter by the difference of the barometric pressures described above.

Figure 14B:
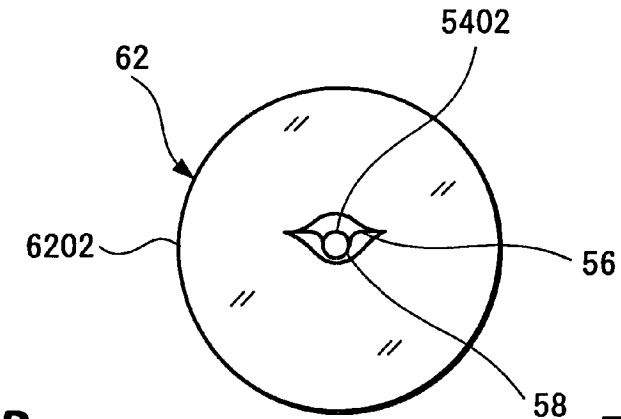
Figure 14C:
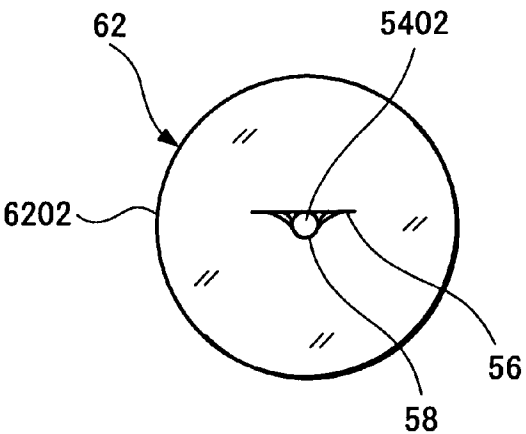
Figure 14D:
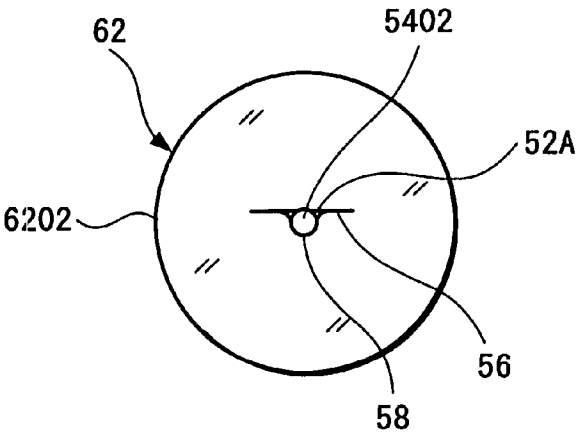

Then, since the sealed metal foil 56 becomes resistance when an inner surface of the fused small diameter portion 6402 comes in contact with both ends in the widthwise direction of the sealed metal foil 56, the inner surface of the fused small diameter portion 6402 shrinks to come close toward the sealed metal foil 56 in the direction orthogonal to the widthwise direction of the sealed metal foil 56 as shown in FIGS. 14B and 14C. Further, the portion of the fused small diameter portion 6402 wraps the electrode axis 5402 and sealed metal foil 56, and, as shown in FIG. 14D, the portion of the fused small diameter portion 6402, that is, the fused glass material, adheres closely to the whole area of the rear surface 5604 on the side opposite to the surface 5602 where the electrode axis 5402 is welded in the sealed metal foil 56, specifically, adheres closely to the whole area of the rear surface 5604 including the rear surface 5604 of the curved portion 58. Furthermore, the fused glass material portion also adheres closely to the portion of the outer circumferential surface 5406 positioned on the side opposite to the sealed metal foil 56 in the outer circumferential surface 5402A of the electrode axis 5402. In this way, the short-arc type high pressure discharge lamp 50 shown in FIG. 7, in which the electrode axis 5402 and sealed metal foil 56 extend in parallel with the axis portion 5202, is obtained.

FIG. 15A is an enlarged view showing the portions of the electrode axis and sealed metal foil, and FIG. 15B is an enlarged view showing the inside of a circle in FIG. 15A. As shown in FIGS. 15A and 15B, on both sides of the electrode axis 5402 between the outer circumferential surface 5406 thereof and the curved portion 58 of the sealed metal foil 56 (specifically, cylindrical surface portion 5814), the glass material portions 52A into which the glass material enters respectively are provided and also the gaps S3 continuous with the sealed space 60 remain among the glass material portion 52A, the outer circumferential surface 5406 of the electrode axis 5402, and the curved portion 58 (specifically, cylindrical surface portion 5814). The gap S3 is formed to be gradually small in the direction away from the glass material portion 52A and along the circumferential direction of the electrode axis 5402. Further, the surface 52-1 of the glass material portion 52A facing the gap S3 forms an obtuse angle $\phi$ with the curved portion 58 (specifically, cylindrical surface portion 5814), in other words, the angle of the gap S3-1 in the portion where the surface 52-1 of the glass material portion 52A facing the gap S3 contacts with the surface 5602 of the curved portion 58 (specifically, cylindrical surface portion 5814) of the sealed metal foil 56 facing the gap S3 is the obtuse angle $\phi$. Here, although FIGS. 15A and 15B are illustrated that the fused glass material closely adheres to half the outer circumferential surface 5406 of the electrode axis 5402 positioned on the side opposite to the portion where the sealed metal foil 56 is welded, the gaps S3 on both sides of the electrode axis 5402 are continuous in actuality through the half portion of the outer circumferential surface 5406 of this electrode axis 5402.

According to this embodiment, since the angle formed by the surface 52-1 of the glass material portion 52A facing the gap S3 continuous with the sealed space 60 and the curved portion 58 of the sealed metal foil 56 is an obtuse angle $\phi$, the force to act on the portion of the gap S3-1 forming the obtuse angle $\phi$ between the surface 52-1 of the glass material portion 52A facing the gap S3 and the surface 5602 of the curved portion 58 of the sealed metal foil 56 can almost be ignored when the short-arc type high pressure discharge lamp 50 is lit to make mercury vapor pressure in the sealed space 60 rise, which causes the pressure in the gap S3 to rise. Therefore, a crack can be prevented from occurring at the portion of the gap S3-1 along the boundary surface between the surface 5602 of the sealed metal foil 56 and the surface 52-1 of the glass material portion 52A, which is advantageous on improving the durability of the short-arc type high pressure discharge lamp 50 and lamp apparatus 30.

It should be understood by those skilled in the art that various modifications, combinations, sub-combinations and alterations may occur depending on design requirements and other factors insofar as they are within the scope of the appended claims or the equivalents thereof.

What is claimed is:

1. A short-arc type high pressure discharge lamp having gaps formed among electrode axes, metal foils and a glass material surface, comprising:

a discharge container made of glass material, having two axis portions and a swelled portion between the two axis portions;

two electrodes, each having an electrode axis and an electrode body at the end of the electrode axis; and two metal foils, each being strip-shaped and having a connection portion at one end, wherein the connection portion of each metal foil is partitioned widthwise into a widthwise middle portion and two widthwise side portions, and the widthwise middle portion is curved to form a groove extending in the longitudinal direction of the metal foil, the groove including:

a bottom, and two longitudinal convex surfaces that connect the bottom to the two widthwise side portions, and wherein the electrode axes of the two electrodes are welded to the bottoms of the grooves of the respective metal foils, the bottoms partially wrapping the respective electrode axes, and wherein the bodies of the two electrodes are housed in the swelled portion of the discharger container, with the electrode axes and the welded metal foils extending to the respective axis portions of the discharger container, and wherein the axis portions of the discharger container are fused to hermetically seal the electrode bodies of the two electrodes in a discharge space located in the swollen portion of the discharger container, and wherein within each of the fused axis portions, two gaps are formed among the glass material, the circumferential surface of the electrode axis, and the longitudinal convex surfaces of the groove of the metal foil, and the gaps are connected to the discharge space in the swollen portion of the discharger container, and wherein within each gap, an obtuse angle is formed between the glass material and the longitudinal convex surface for preventing formation and growth of cracks in the interface of the glass material and the metal foil.

2. A short-arc type high pressure discharge lamp according to claim 1, wherein within the connection portion of each of the two metal foils, the bottom of the groove is substantially semi-cylinder-shaped, having a diameter approximately equal to the diameter of the electrode axis of the electrode, and the longitudinal convex surfaces smoothly connect the bottom to the two widthwise side portions.

3. A short-arc type high pressure discharge lamp according to claim 2, wherein the depth of the groove of the widthwise middle portion of the connection portion of each of the two metal foils is approximately equal to the diameter of the electrode axes of the electrodes.

4. A lamp apparatus comprising:

a short-arc type high pressure discharge lamp having gaps formed among electrode axes, metal foils and a glass material surface;

a protective tube that accommodates said the short-arc type high pressure discharge lamp in the hermetically sealed state;

an opening provided in the front portion of the protective tube;

a transparent panel that closes the opening hermetically;

a reflective surface provided on the inner surface of the protective tube for reflecting light emitted from the short-arc type high pressure discharge lamp and for leading the light forward through the transparent panel; and a power terminal provided on the outer surface of the protective tube, the short-arc type high pressure discharge lamp including:

a discharge container made of glass material, having two axis portions and a swelled portion between the two axis portions;

two electrodes, each having an electrode axis and an electrode body at the end of the electrode axis; and two metal foils, each being strip-shaped and having a connection portion at one end, wherein the connection portion of each metal foil is partitioned widthwise into a widthwise middle portion and two widthwise side portions, and the widthwise middle portion is curved to form a groove extending in the longitudinal direction of the metal foil, the groove including:

a bottom, and two longitudinal convex surfaces that connect the bottom to the two widthwise side portions, and wherein the electrode axes of the two electrodes are welded to the bottoms of the grooves of the respective metal foils, the bottoms partially wrapping the respective electrode axes, and wherein the bodies of the two electrodes are housed in the swelled portion of the discharger container, with the electrode axes and the welded metal foils extending to the respective axis portions of the discharger container, and wherein the axis portions of the discharger container are fused to hermetically seal the electrode bodies of the two electrodes in a discharge space located in the swollen portion of the discharger container, and wherein within each of the fused axis portions, two gaps are formed among the glass material, the circumferential surface of the electrode axis, and the longitudinal convex surfaces of the groove of the metal foil, and the gaps are connected to the discharge space in the swollen portion of the discharger container, and wherein within each gap, an obtuse angle is formed between the glass material and the longitudinal convex surface for preventing formation and growth of cracks in the interface of the glass material and the metal foil.

5. A lamp apparatus according to claim 4, wherein within the connection portion of each of the two metal foils, the bottom of the groove is substantially semi-cylinder-shaped, having a diameter approximately equal to the diameter of the electrode axis of the electrode, and the longitudinal convex surfaces smoothly connect the bottom to the two widthwise side portions.

6. A lamp apparatus according to claim 5, wherein the depth of the groove of the widthwise middle portion of the connection portion of each of the two metal foils is approximately equal to the diameter of the electrode axes of the electrodes.

* * * * *